US011788685B2

(12) United States Patent
Chow et al.

(10) Patent No.: US 11,788,685 B2
(45) Date of Patent: Oct. 17, 2023

(54) 1 KELVIN AND 300 MILLIKELVIN THERMAL STAGES FOR CRYOGENIC ENVIRONMENTS

(71) Applicant: International Business Machines Corporation, Armonk, NY (US)

(72) Inventors: Jerry M. Chow, Scarsdale, NY (US); Patryk Gumann, Tarrytown, NY (US)

(73) Assignee: International Business Machines Corporation, Armonk, NY (US)

( * ) Notice: Subject to any disclaimer, the term of this patent is extended or adjusted under 35 U.S.C. 154(b) by 310 days.

(21) Appl. No.: 17/144,749

(22) Filed: Jan. 8, 2021

(65) Prior Publication Data

US 2022/0221104 A1 Jul. 14, 2022

(51) Int. Cl.

| | |
|---|---|
| ***F17C 3/08*** | (2006.01) |
| ***F25B 9/10*** | (2006.01) |
| ***F25B 9/12*** | (2006.01) |

(52) U.S. Cl.

CPC ..... *F17C 3/085* (2013.01); *F25B 9/10* (2013.01); *F25B 9/12* (2013.01)

(58) Field of Classification Search

CPC ..... F17C 3/085; F25B 9/10

See application file for complete search history.

(56) References Cited

U.S. PATENT DOCUMENTS

2016/0377230 A1* 12/2016 Chuard ..... G01J 5/061 62/447
2019/0383525 A1* 12/2019 Matthews ..... F25B 9/10
2020/0363014 A1 11/2020 Hart et al.

FOREIGN PATENT DOCUMENTS

| | | | |
|---|---|---|---|
| EP | 3 584 516 | A1 | 12/2019 |
| EP | 3 742 076 | A1 | 11/2020 |
| JP | 2009-074774 | A | 4/2009 |

OTHER PUBLICATIONS

Goetz Jan: "The Interplay of Superconducting Quantum Circuits and Propagating Microwave States", Ph. D. Thesis dissertation, Jun. 26, 2017 (Jun. 26, 2017), pp. 1-226, XP055801252, Retrieved from the Internet: URL:http://mediatum.ub.tum.de/doc/1326240/1326240.pdf (Year: 2017).*

(Continued)

*Primary Examiner* — Lionel Nouketcha
(74) *Attorney, Agent, or Firm* — Amin, Turocy & Watson, LLP

(57) ABSTRACT

Techniques facilitating efficient thermal profile management within cryogenic environments are provided. In one example, a cryostat can comprise a plurality of thermal stages intervening between a 4-Kelvin (K) stage and a Cold Plate stage. The plurality of thermal stages can include a Still stage and an intermediate thermal stage that provides additional cooling capacity for the cryostat. The intermediate thermal stage can be directly coupled mechanically to the Still stage via a support rod.

23 Claims, 5 Drawing Sheets

(56) References Cited

OTHER PUBLICATIONS

International Search Report and Written Opinion received for PCT Application Serial No. PCT/EP2021/087869 dated Apr. 25, 2022, 13 pages.
Goetz, Jan., "The Interplay of Superconducting Quantum Circuits and Propagating Microwave States", Ph D. Thesis dissertation, Jun. 26, 2017, pp. 1-112.
Goetz, Jan., "The Interplay of Superconducting Quantum Circuits and Propagating Microwave States", Ph.D. Thesis dissertation, Jun. 26, 2017, pp. 113-218.
Krinner et al., "Engineering Cryogenic Setups for 100-Qubit Scale Superconducting Circuit Systems", EPJ Quantum Technology, vol. 6, No. 2, 2019, 29 pages.

* cited by examiner

1 KELVIN AND 300 MILLIKELVIN THERMAL STAGES FOR CRYOGENIC ENVIRONMENTS

BACKGROUND

The subject disclosure relates to cryogenic environments, and more specifically, to techniques of facilitating efficient thermal profile management within cryogenic environments.

A cryostat can maintain samples or devices positioned on a sample mounting surface located within the cryostat at temperatures approaching absolute zero to facilitate evaluating such samples or devices under cryogenic conditions. Cryostats generally provide such low temperatures utilizing five thermal stages that are mechanically coupled to a room temperature plate of an outer vacuum chamber that encloses the five thermal stages. The five thermal stages of a cryostat comprise a thermal profile in which each subsequent thermal stage has a progressively lower temperature than exists at a preceding thermal stage.

In addition to having progressively lower temperatures, each subsequent thermal stage generally has progressively lower cooling power available than is available at a preceding thermal stage. For example, while a 50 kelvin (50-K) stage can have 30 watts (W) of available cooling power at a temperature of 50 K, a 4 kelvin (4-K) stage may have 1.5 W of available cooling power at a temperature of 4 K, and a mixing chamber stage generally associated with a lowest temperature within a cryostat may have 20 microwatts (u W) of available cooling power at a temperature of 20 millikelvin (mK). As such, efficiently managing available cooling power can become increasingly important at lower temperature regions within a thermal profile of a cryostat.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, devices, and/or methods that facilitate efficient thermal profile management within cryogenic environments are described.

According to an embodiment, a cryostat can comprise a plurality of thermal stages intervening between a 4-Kelvin (K) stage and a cold plate stage. The plurality of thermal stages can include a still stage and an intermediate thermal stage that provides additional cooling capacity for the cryostat. The intermediate thermal stage can be directly coupled mechanically to the still stage via a support rod. One aspect of such a cryostat is that the cryostat can facilitate efficient thermal profile management within cryogenic environments.

In an embodiment, the intermediate thermal stage can operate at a temperature of about 1 kelvin (K). One aspect of such a cryostat is that the cryostat can facilitate increasing the cooling power of the still stage, the cold plate stage, and/or the mixing chamber stage by exposing those stages to 1 K blackbody radiation instead of 4 K blackbody radiation.

According to another embodiment, a cryostat can comprise a still stage directly coupled mechanically to an intermediate thermal stage via a support rod. The intermediate thermal stage can provide additional cooling capacity for the cryostat. The still stage and the intermediate thermal stage can be included among a plurality of thermal stages intervening between a 4-K stage and a cold plate stage. One aspect of such a cryostat is that the cryostat can facilitate efficient thermal profile management within cryogenic environments.

In an embodiment, the intermediate thermal stage can operate at a temperature of about 300 millikelvin (mK). One aspect of such a cryostat is that the cryostat can facilitate increasing the cooling power of the cold plate stage and/or the mixing chamber stage by exposing those stages to 300 mK blackbody radiation instead of 700 mK blackbody radiation.

According to another embodiment, a cryostat can comprise a sealed pot that facilitates evaporative cooling of a helium medium. The sealed pot can be coupled to an intermediate thermal stage that provides additional cooling capacity for the cryostat. The intermediate thermal stage can be directly coupled mechanically to a still stage via a support rod. The still stage and the intermediate thermal stage can be included among a plurality of thermal stages intervening between a 4-K stage and a cold plate stage. One aspect of such a cryostat is that the cryostat can facilitate efficient thermal profile management within cryogenic environments.

In an embodiment, the sealed pot can comprise sintered material. One aspect of such a cryostat is that the cryostat can facilitate thermal budget optimization.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

Figure 1:
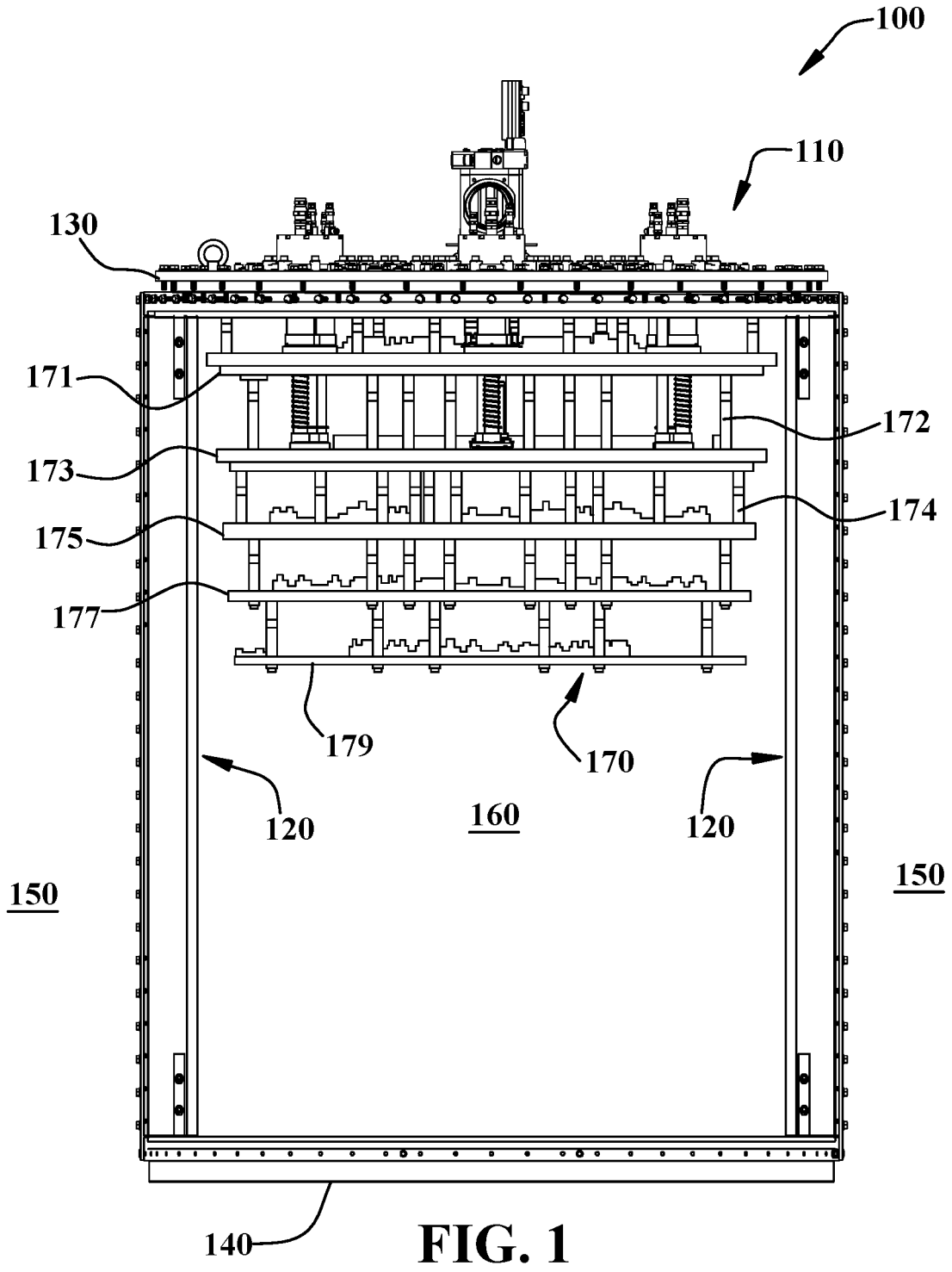
FIG. 1 illustrates an example, non-limiting cryostat, in accordance with one or more embodiments described herein.

FIG. 1 illustrates an example, non-limiting cryostat 100, in accordance with one or more embodiments described herein. As shown in FIG. 1, cryostat 100 comprises an outer vacuum chamber 110 formed by a sidewall 120 intervening between a top plate 130 and a bottom plate 140. In operation, outer vacuum chamber 110 can maintain a pressure differential between an ambient environment 150 of outer vacuum chamber 110 and an interior 160 of outer vacuum chamber 110. Cryostat 100 further comprises a plurality of thermal stages (or stages) 170 disposed within interior 160 that are each mechanically coupled to top plate 130. The plurality of stages 170 includes: stage 171, stage 173, stage 175, stage 177, and stage 179. Each stage among the plurality of stages 170 can be associated with a different temperature. For example, stage 171 can be a 50-kelvin (50-K) stage that is associated with a temperature of 50 kelvin (K), stage 173 can be a 4-kelvin (4-K) stage that is associated with a temperature of 4 K, stage 175 can be associated with a temperature of 700 millikelvin (mK), stage 177 can be associated with a temperature of 100 mK, and stage 179 can be associated with a temperature of 10 mK. Each stage among the plurality of stages 170 is spatially isolated from other stages of the plurality of stages 170 by a plurality of support rods (e.g., support rods 172 and 174). In an embodiment, stage 175 can be a still stage, stage 177 can be a cold plate stage, and stage 179 can be a mixing chamber stage.

Figure 2:
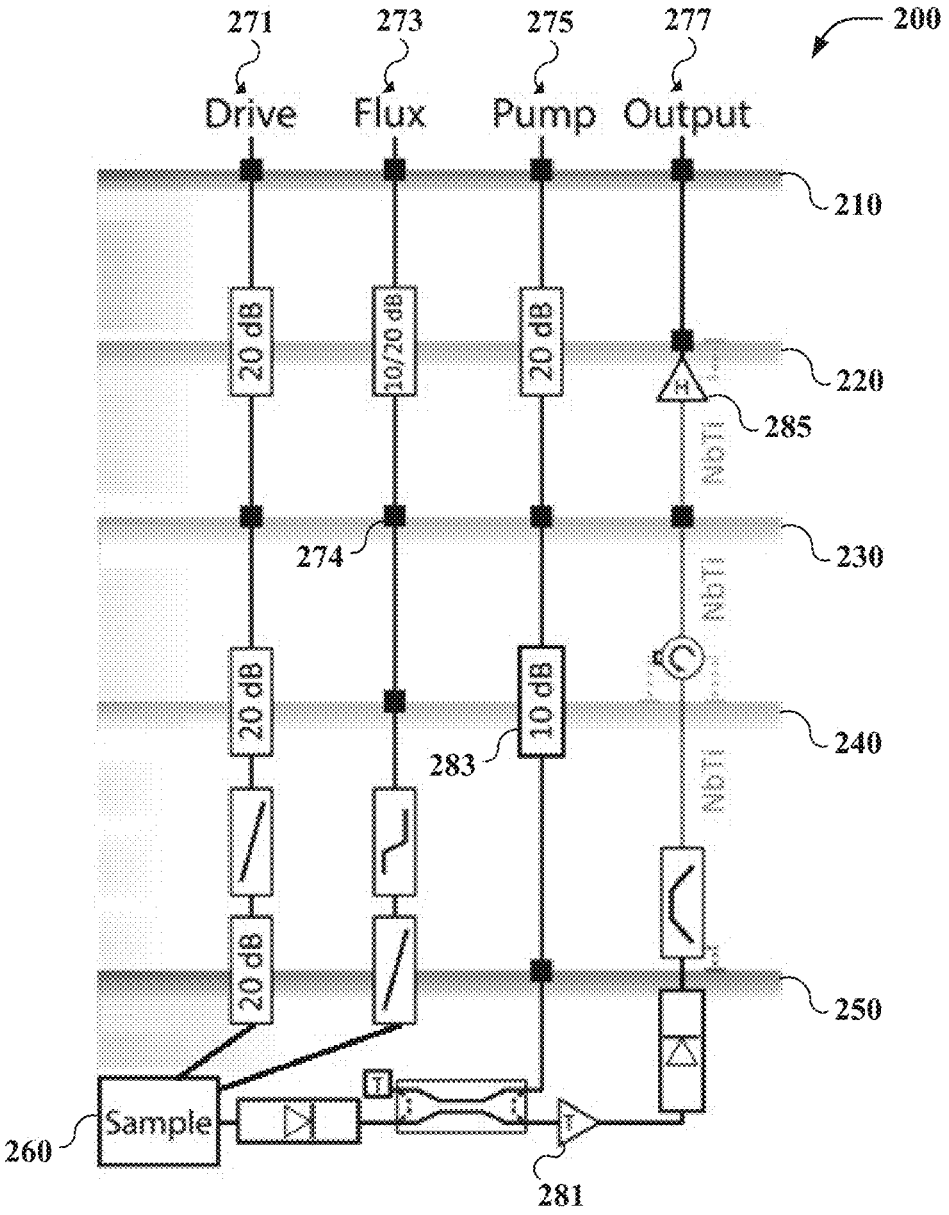
FIG. 2 illustrates a circuit schematic of an example, non-limiting cryostat, in accordance with one or more embodiments described herein.

FIG. 2 illustrates a circuit schematic of an example, non-limiting cryostat 200, in accordance with one or more embodiments described herein. As discussed above, a cryostat can maintain samples or devices positioned on a sample mounting surface located within the cryostat at temperatures approaching absolute zero to facilitate evaluating such samples or devices under cryogenic conditions. Evaluating samples or devices under cryogenic conditions generally involves interacting with such samples or devices using one or more devices external to a cryostat that sit at room temperature conditions. To that end, a cryostat can include input/output (I/O) lines that facilitate propagation of electrical signals between a sample positioned within the cryostat and the devices external to the cryostat.

By way of example, superconducting qubits can be positioned on a sample mounting surface 260 of cryostat 200. Coupling the superconducting qubits positioned on sample mounting surface 260 to one or more devices external to cryostat 200 are four I/O lines: a drive line 271; a flux line 273; a pump line 275; and an output (or readout) line 277. One skilled in the art will appreciate that these four I/O lines can contribute to a heat load placed on cryostat 200 in a number ways. One way that the four I/O lines can contribute to the heat load is that each I/O line can provide a thermal path along which heat can be conducted from higher temperature thermal stages to lower temperature thermal stages. For example, in FIG. 2, drive line 271 is routed from a 50-K stage 210 of cryostat 200 to a mixing chamber stage 250. Along that routing path through cryostat 200, drive line 271 can provide a thermal path through which heat can be conducted from higher temperature thermal stages to lower temperature thermal stages, such as from 50-K stage 210 to a 4-K stage 220.

Another way that the four I/O lines can contribute to the heat load relates to heat (e.g., Joule heating) generated due to dissipation of signals propagating along a given I/O line or via an intervening electrical component. For example, a microwave flux signal propagating along flux line 273 towards a SQUID loop associated with the superconducting qubits positioned on sample mounting surface 260 can introduce heat on a still stage 230 of cryostat 200 via a thermal coupling 274. As another example, a microwave pump signal propagating along flux line 273 for operation of a traveling wave parametric amplifier (TWPA) 283 can introduce heat on a Cold stage 240 via an attenuator 285 coupled to flux line 273 and Cold stage 240.

Another way that the four I/O lines can contribute to the heat load involves a radiative load that higher temperature thermal stages represent to lower temperature thermal stages. For example, direct current (DC) signals biasing a high electron mobility transistor (HEMT) amplifier 285 to facilitate measurement of the superconducting qubits positioned on sample mounting surface 260 via output line 277 can introduce heat on the 4-K stage 220. Such heat introduced on the 4-K stage 220 can expose lower temperature thermal stages (e.g., still stage 230) a radiative load that the 4-K stage 220 represents to the lower temperature thermal stages as 4 K blackbody radiation.

As discussed above, each subsequent thermal stage of a cryostat generally has progressively lower cooling power available than is available at a preceding thermal stage. Therefore, efficiently managing available cooling power can become increasingly important at lower temperature regions within a thermal profile of a cryostat. Embodiments described herein facilitating efficient thermal profile management within cryogenic environments by implementing intermediate thermal stages that can provide additional cooling capacity. For example, in accordance with various embodiments, additional cooling capacity provided by an intermediate thermal stage can improve thermal profile management efficiency by reducing heat that can be conducted from higher temperature thermal stages to lower temperature thermal stages via I/O lines. As another example, in accordance with various embodiments, intermediate thermal stages can improve thermal profile management efficiency by exposing lower temperature thermal stages to radiative load having lower-level blackbody radiation.

Figure 3:
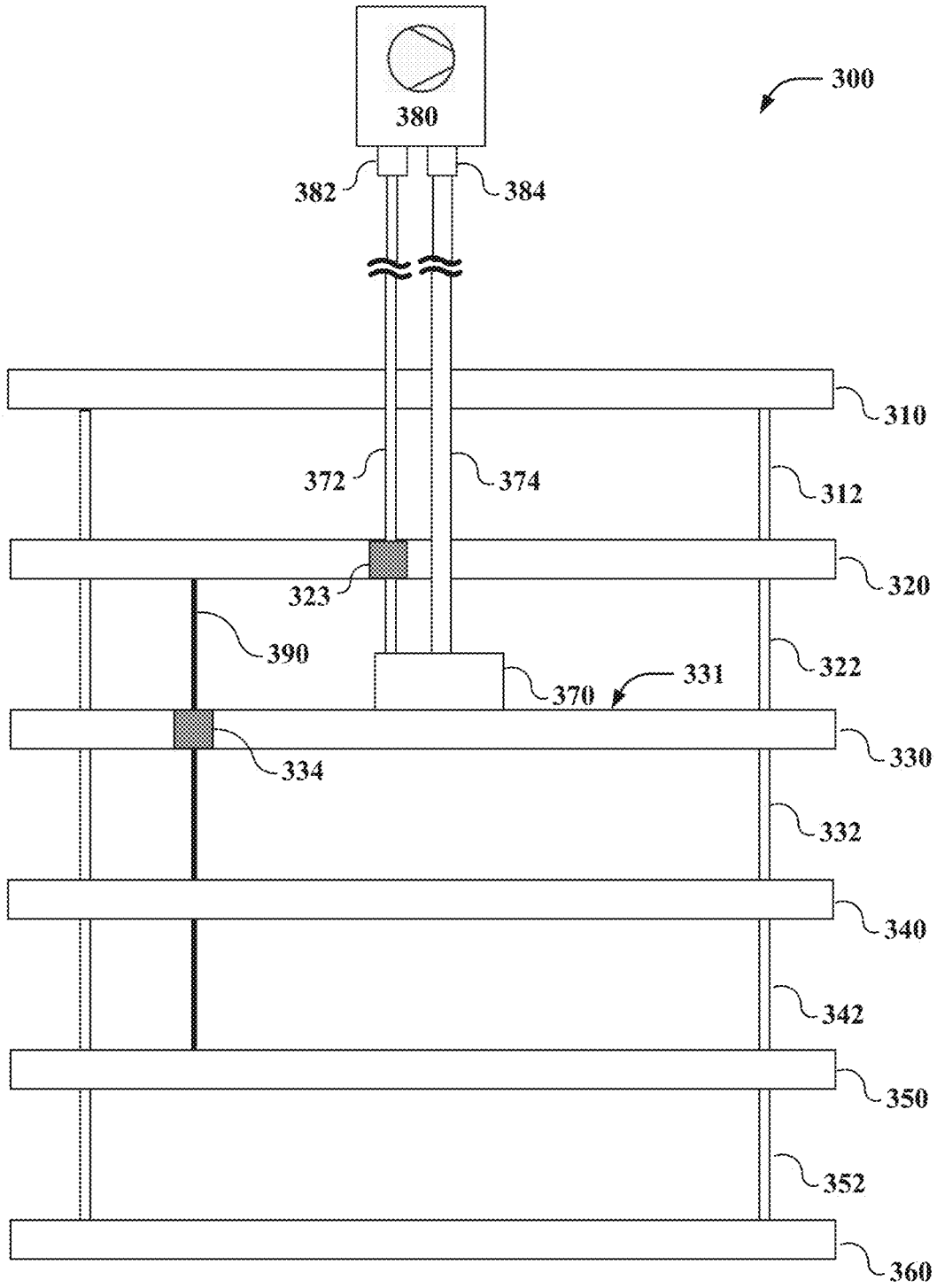
FIG. 3 illustrates an example, non-limiting cryostat with an intermediate thermal stage that provides additional cooling capacity, in accordance with one or more embodiments described herein.

FIG. 3 illustrates an example, non-limiting cryostat 300 with an intermediate thermal stage that provides additional cooling capacity, in accordance with one or more embodiments described herein. As shown by FIG. 3, cryostat 300 comprises a 50-K stage 310 that can be coupled to a room temperature plate (e.g., top plate 130 of FIG. 1) of an outer vacuum chamber. FIG. 3 also shows that cryostat 300 further comprises a plurality of thermal stages intervening between a 4-K stage 320 and a cold plate stage 340. Those plurality of thermal stages include a still stage 340 and an intermediate thermal stage 330. Intermediate thermal stage 330 is directly coupled mechanically to 4-K stage 320 via support rod 322 and still stage 340 via support rod 332. Intermediate thermal stage 330 is indirectly coupled mechanically to 50-K stage 310 via support rod 312, cold plate stage 350 via support rod 342, and mixing chamber stage 360 via support rod 352. Surface 331 of intermediate thermal stage 330 can be implemented in various shapes. For example, surface 331 can be implemented as a circle, a quadrant, a triangle, a quadrilateral, and the like. As another example, surface 331 can be implemented as an amorphous shape.

Intermediate thermal stage 330 can comprise a feed-through element 334 that intervenes in a wiring structure 390 that facilitates propagation of electrical signals between 4-K stage 320 and cold plate stage 350. Wiring structure 390 can comprise an I/O line coupling a sample positioned within cryostat 300 and one or more devices external to cryostat 300. For example, wiring structure 390 can comprise an I/O line such as drive line 271, flux line 273, pump line 275, and/or output (or readout) line 277 of FIG. 2. In an embodiment, intermediate thermal stage 330 can comprise copper, gold, silver, brass, platinum, or a combination thereof.

Intermediate thermal stage 330 can provide additional cooling capacity for cryostat 300 via a sealed pot 370 coupled to intermediate thermal stage 330. To that end, sealed pot 370 facilitates evaporative cooling of a helium medium—helium-4. A condenser line 372 can couple an outlet port 382 of a pump 380 to sealed pot 370 via 4-K stage 320. In an embodiment, pump 380 can be a vacuum pump for circulating a helium medium through sealed pot 370. In an embodiment, pump 380 is located external to cryostat 300. In an embodiment, pump 380 is located within cryostat 300. In this embodiment, pump 380 can be implemented as a sorb pump. Condenser line 372 can provide a return path for the helium medium to sealed pot 370. A pumping line 374 can couple an inlet port 384 of pump 380 to sealed pot 370 via 4-K stage 320. 4-K stage 320 can provide passage for condenser line 372 and/or pumping line 374 via a feedthrough element, such as feedthrough element 323.

In operation, helium-4 can flow from outlet port 382 towards sealed pot 370 in a gaseous state. Feedthrough element 323 can thermally anchor condenser line 372 to 4-K stage 320. As the helium-4 flows past feedthrough element 323, the helium-4 can transition from the gaseous state to a liquid state. Helium-4 in the liquid state can collect in sealed pot 370. Inlet port 384 of pump 380 can reduce a pressure above the liquified helium-4 collected in sealed pot 370. Helium-4 in the gaseous state can form above the liquified helium-4 collected in sealed pot 370 through evaporation and flow to inlet port 384 of pump 380 via pumping line 374. Heat carried by the helium-4 in the gaseous state flowing through pumping line 374 can reduce a temperature of the liquified helium-4 remaining in sealed pot 370. Such evaporative cooling of the liquified helium-4 in sealed pot 370 can reduce a temperature of intermediate thermal stage 330 such that intermediate thermal stage 330 can operate at a temperature of about 1 K. In an embodiment, sealed pot 370 can be vacuum sealed or cryogenically sealed. In an embodiment, sealed pot 370 can comprise sintered material that facilitates thermal budget optimization. The sintered material can comprise silver, gold, copper, platinum, and the like.

Figure 4:
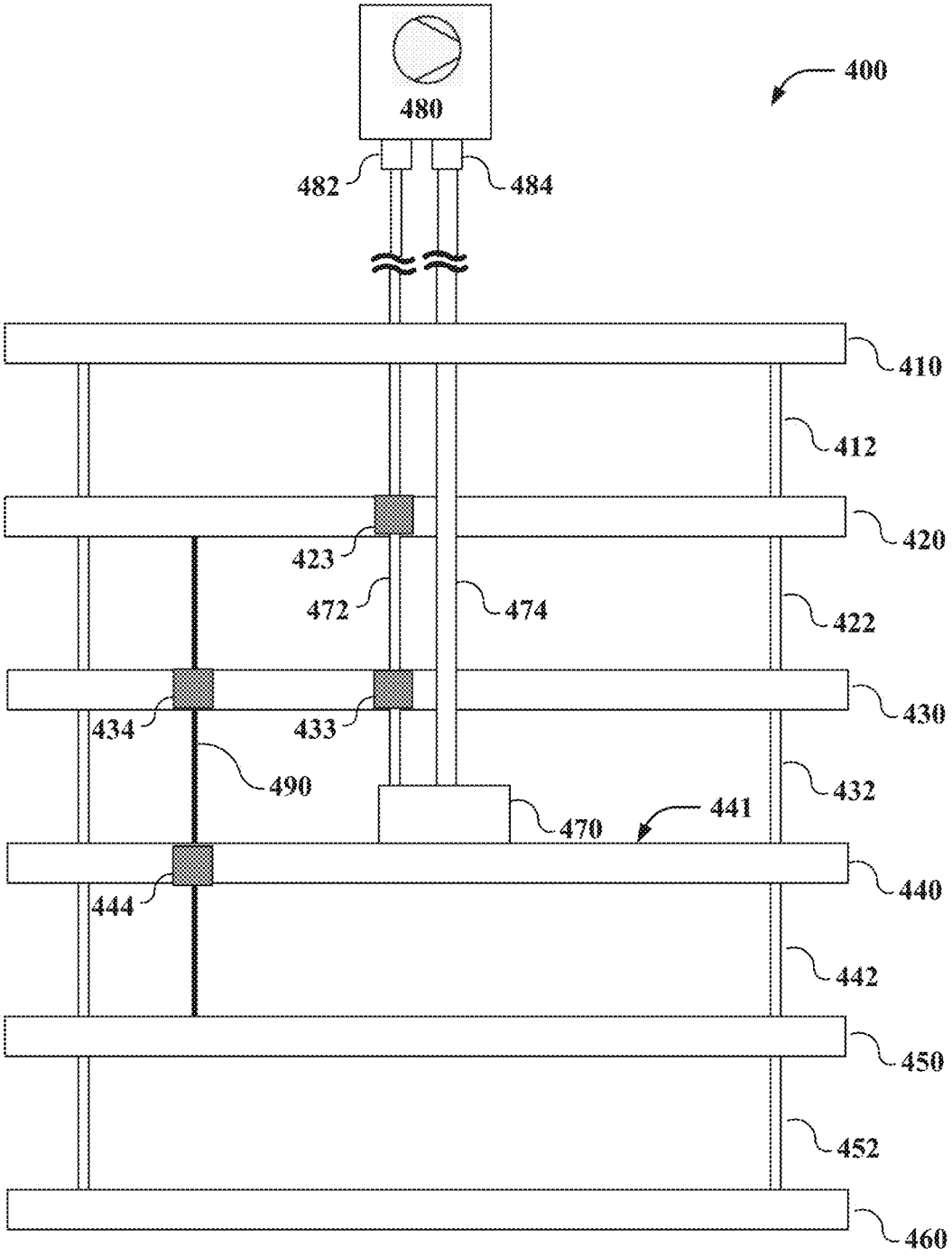
FIG. 4 illustrates another example, non-limiting cryostat with an intermediate thermal stage that provides additional cooling capacity, in accordance with one or more embodiments described herein.

FIG. 4 illustrates another example, non-limiting cryostat 400 with an intermediate thermal stage that provides additional cooling capacity, in accordance with one or more embodiments described herein. As shown by FIG. 4, cryostat 400 comprises a 50-K stage 410 that can be coupled to a room temperature plate (e.g., top plate 130 of FIG. 1) of an outer vacuum chamber. FIG. 4 also shows that cryostat 400 further comprises a plurality of thermal stages intervening between a 4-K stage 420 and a cold plate stage 450. Those plurality of thermal stages include a still stage 430 and an intermediate thermal stage 440. Intermediate thermal stage 440 is directly coupled mechanically to still stage 430 via support rod 432 and cold plate stage 450 via support rod 442. Intermediate thermal stage 440 is indirectly coupled mechanically to 50-K stage 410 via support rod 412, 4-K stage 420 via support rod 422, and mixing chamber stage 460 via support rod 452. Surface 441 of intermediate thermal stage 440 can be implemented in various shapes. For example, surface 441 can be implemented as a circle, a quadrant, a triangle, a quadrilateral, and the like. As another example, surface 441 can be implemented as an amorphous shape.

Intermediate thermal stage 440 can comprise a feedthrough element 444 that intervenes in a wiring structure 490 that facilitates propagation of electrical signals between 4-K stage 420 and cold plate stage 450. Still stage 430 can also comprise a feedthrough element 434 that intervenes in wiring structure 490. Wiring structure 490 can comprise an I/O line coupling a sample positioned within cryostat 400 and one or more devices external to cryostat 400. For example, wiring structure 490 can comprise an I/O line such as drive line 271, flux line 273, pump line 275, and/or output (or readout) line 277 of FIG. 2. In an embodiment, intermediate thermal stage 440 can comprise copper, gold, silver, brass, platinum, or a combination thereof.

Intermediate thermal stage 440 can provide additional cooling capacity for cryostat 400 via a sealed pot 470 coupled to intermediate thermal stage 440. To that end, sealed pot 470 facilitates evaporative cooling of a helium medium—helium-3. A condenser line 472 can couple an outlet port 482 of a pump 480 to sealed pot 470 via 4-K stage 420. In an embodiment, pump 480 is located external to cryostat 400. In an embodiment, pump 480 can be a vacuum pump for circulating a helium medium through sealed pot 470. In an embodiment, pump 480 is located within cryostat 400. In this embodiment, pump 480 can be implemented as a sorb pump. Condenser line 472 can provide a return path for the helium medium to sealed pot 470. A pumping line 474 can couple an inlet port 484 of pump 480 to sealed pot 470 via 4-K stage 420. 4-K stage 420 can provide passage for condenser line 472 and/or pumping line 474 via a feedthrough element, such as feedthrough element 423. Still stage 430 can provide passage for condenser line 472 and/or pumping line 474 via a feedthrough element, such as feedthrough element 433.

In operation, helium-3 can flow from outlet port 482 towards sealed pot 470 in a gaseous state. Feedthrough elements 423 and/or 433 can thermally anchor condenser line 472 to 4-K stage 420 and/or still stage 430, respectively. As the helium-3 flows past feedthrough elements 423 and/or 433, the helium-3 can transition from the gaseous state to a liquid state. Helium-3 in the liquid state can collect in sealed pot 470. Inlet port 484 of pump 480 can reduce a pressure above the liquified helium-3 collected in sealed pot 470. Helium-3 in the gaseous state can form above the liquified helium-3 collected in sealed pot 470 through evaporation and flow to inlet port 484 of pump 480 via pumping line 474. Heat carried by the helium-3 in the gaseous state flowing through pumping line 474 can reduce a temperature of the liquified helium-3 remaining in sealed pot 470. Such evaporative cooling of the liquified helium-3 in sealed pot 470 can reduce a temperature of intermediate thermal stage 440 such that intermediate thermal stage 440 can operate at a temperature of about 300 mK. In an embodiment, sealed pot 470 can be vacuum sealed or cryogenically sealed. In an embodiment, sealed pot 470 can comprise sintered material that facilitates thermal budget optimization. The sintered material can comprise silver, gold, copper, platinum, and the like.

Figure 5:
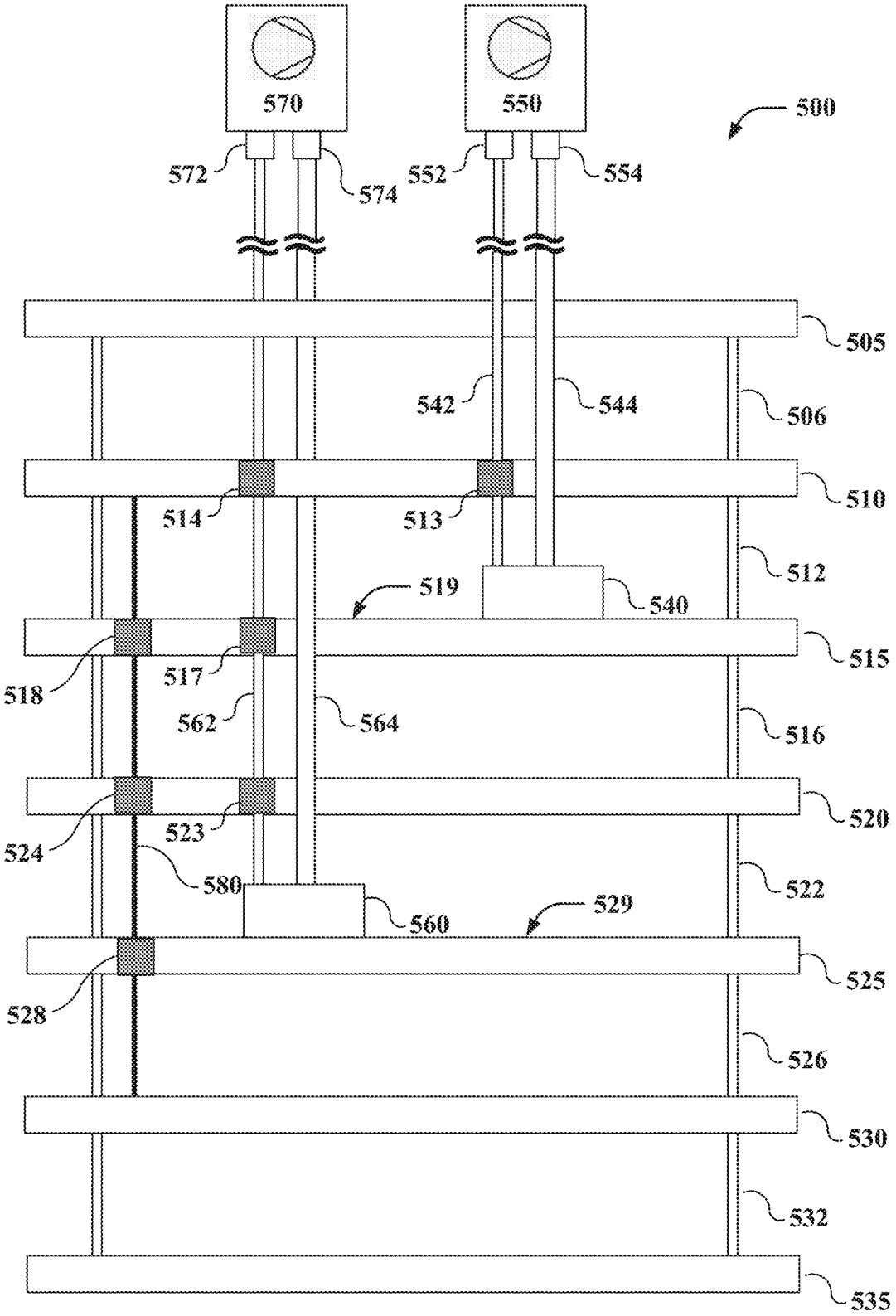
FIG. 5 illustrates an example, non-limiting cryostat with multiple intermediate thermal stage that each provide additional cooling capacity, in accordance with one or more embodiments described herein.

FIG. 5 illustrates an example, non-limiting cryostat with multiple intermediate thermal stage that each provide additional cooling capacity, in accordance with one or more embodiments described herein. As shown by FIG. 5, cryostat 500 comprises a 50-K stage 505 that can be coupled to a room temperature plate (e.g., top plate 130 of FIG. 1) of an outer vacuum chamber. FIG. 5 also shows that cryostat 500 further comprises a plurality of thermal stages intervening between a 4-K stage 510 and a cold plate stage 530. Those plurality of thermal stages include a still stage 520 and multiple intermediate thermal stages (e.g., intermediate thermal stage 515 and intermediate thermal stage 525).

Intermediate thermal stage 515 is directly coupled mechanically to 4-K stage 510 via support rod 512 and still stage 520 via support rod 516. Intermediate thermal stage 515 is indirectly coupled mechanically to 50-K stage 505 via support rod 506, intermediate thermal stage 525 via support rod 522, cold plate stage 530 via support rod 526, and mixing chamber stage 535 via support rod 532. Intermediate thermal stage 525 is directly coupled mechanically to still stage 520 via support rod 522 and cold plate stage 530 via support rod 526. Intermediate thermal stage 525 is indirectly coupled mechanically to 50-K stage 505 via support rod 506, 4-K stage 510 via support rod 512, intermediate thermal stage 515 via support rod 516, and mixing chamber stage 535 via support rod 532. Intermediate thermal stages 515 and 525 are directly coupled mechanically to opposing sides of still stage 520 via support rods 516 and 522, respectively. Surfaces 519 and/or 529 of intermediate thermal stages 515 and 525, respectively, can be implemented in various shapes. For example, surfaces 519 and/or 529 can be implemented as a circle, a quadrant, a triangle, a quadrilateral, and the like. As another example, surfaces 519 and/or 529 can be implemented as an amorphous shape.

Intermediate thermal stages 515 and 525 can comprise feedthrough elements 518 and 528, respectively, that intervene in a wiring structure 580 that facilitates propagation of electrical signals between 4-K stage 510 and cold plate stage 530. Still stage 520 can also comprise a feedthrough element 524 that intervenes in wiring structure 580. Wiring structure 580 can comprise an I/O line coupling a sample positioned within cryostat 500 and one or more devices external to cryostat 500. For example, wiring structure 580 can comprise an I/O line such as drive line 271, flux line 273, pump line 275, and/or output (or readout) line 277 of FIG. 2. In an embodiment, intermediate thermal stages 515 and/or 525 can comprise copper, gold, silver, brass, platinum, or a combination thereof.

Intermediate thermal stage 515 can provide additional cooling capacity for cryostat 500 via a sealed pot 540 coupled to intermediate thermal stage 515. To that end, sealed pot 540 facilitates evaporative cooling of a helium medium—helium-4. A condenser line 542 can couple an outlet port 552 of a pump 550 to sealed pot 540 via 4-K stage 510. Condenser line 542 can provide a return path for that helium medium to sealed pot 540. A pumping line 544 can couple an inlet port 554 of pump 540 to sealed pot 540 via 4-K stage 510. 4-K stage 510 can provide passage for condenser line 542 and/or pumping line 544 via a feedthrough element, such as feedthrough element 513.

In operation, helium-4 can flow from outlet port 552 towards sealed pot 540 in a gaseous state. Feedthrough element 513 can thermally anchor condenser line 542 to 4-K stage 510. As the helium-4 flows past feedthrough element 513, the helium-4 can transition from the gaseous state to a liquid state. Helium-4 in the liquid state can collect in sealed pot 540. Inlet port 554 of pump 550 can reduce a pressure above the liquified helium-4 collected in sealed pot 540. Helium-4 in the gaseous state can form above the liquified helium-4 collected in sealed pot 540 through evaporation and flow to inlet port 554 of pump 550 via pumping line 554. Heat carried by the helium-4 in the gaseous state flowing through pumping line 554 can reduce a temperature of the liquified helium-4 remaining in sealed pot 540. Such evaporative cooling of the liquified helium-4 in sealed pot 540 can reduce a temperature of intermediate thermal stage 515 such that intermediate thermal stage 515 can operate at a temperature of about 1 K.

Intermediate thermal stage 525 can provide additional cooling capacity for cryostat 500 via a sealed pot 560 coupled to intermediate thermal stage 525. To that end, sealed pot 560 facilitates evaporative cooling of a helium medium—helium-3. A condenser line 562 can couple an outlet port 572 of a pump 570 to sealed pot 560 via 4-K stage 510. In an embodiment, pumps 550 and/or 570 can be a vacuum pump for circulating a corresponding helium medium through sealed pots 540 and/or 560, respectively. In an embodiment, pumps 570 and/or 550 can be located external to cryostat 500. In an embodiment, pumps 570 and/or 550 can be located within cryostat 500. In this embodiment, pumps 570 and/or 550 can be implemented as a sorb pump. Condenser line 562 can provide a return path for that helium medium to sealed pot 560. A pumping line 564 can couple an inlet port 574 of pump 570 to sealed pot 560 via 4-K stage 510. 4-K stage 510 can provide passage for condenser line 562 and/or pumping line 564 via a feedthrough element, such as feedthrough element 514. Intermediate thermal stage 515 can provide passage for condenser line 562 and/or pumping line 564 via a feedthrough element, such as feedthrough element 517. Still stage 520 can provide passage for condenser line 562 and/or pumping line 564 via a feedthrough element, such as feedthrough element 523.

In operation, helium-3 can flow from outlet port 572 towards sealed pot 560 in a gaseous state. Feedthrough elements 514, 517, and/or 523 can thermally anchor condenser line 562 to 4-K stage 510, intermediate thermal stage 515, and/or Still stage 520, respectively. As the helium-3 flows past feedthrough elements 515, 517, and/or 523, the helium-3 can transition from the gaseous state to a liquid state. Helium-3 in the liquid state can collect in sealed pot 560. Inlet port 574 of pump 570 can reduce a pressure above the liquified helium-3 collected in sealed pot 560. Helium-3 in the gaseous state can form above the liquified helium-3 collected in sealed pot 560 through evaporation and flow to inlet port 574 of pump 570 via pumping line 564. Heat carried by the helium-3 in the gaseous state flowing through pumping line 564 can reduce a temperature of the liquified helium-3 remaining in sealed pot 560. Such evaporative cooling of the liquified helium-3 in sealed pot 560 can reduce a temperature of intermediate thermal stage 525 such that intermediate thermal stage 525 can operate at a temperature of about 300 mK. In an embodiment, sealed pots 540 and/or 560 can be vacuum sealed or cryogenically sealed. In an embodiment, sealed pots 540 and/or 560 can comprise sintered material that facilitates thermal budget optimization. The sintered material can comprise silver, gold, copper, platinum, and the like.

Embodiments of the present invention may be a system, a method, and/or an apparatus at any possible technical detail level of integration. What has been described above includes mere examples of systems, methods, and apparatus. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While certain example embodiments have been described, these embodiments have been presented by way of example only, and are not intended to limit the scope the disclosures herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the disclosures herein. The accompanying claims and their equivalents are intended to cover such forms or modifications as would fall within the scope and spirit of certain of the disclosures herein.

What is claimed is:

1. A cryostat, comprising:

a plurality of thermal stages intervening between a 4-kelvin (4-K) stage and a cold plate stage, the plurality of thermal stages including a still stage and an intermediate thermal stage that provides additional cooling capacity for the cryostat, wherein the intermediate thermal stage is directly coupled mechanically to the still stage and additionally to the 4-K stage or the cold plate stage via respective support rods, and wherein a pump coupled to the intermediate thermal stage enables circulation of a helium medium through a sealed pot coupled to the intermediate thermal stage to maintain temperature of the intermediate thermal stage below a defined threshold.

2. The cryostat of claim 1, wherein the intermediate thermal stage operates at a temperature of about 1 kelvin.

3. The cryostat of claim 1, wherein the intermediate thermal stage operates at a temperature of about 300 millikelvin (mK).

4. The cryostat of claim 1, wherein the sealed pot coupled to the intermediate thermal stage facilitates evaporative cooling of the helium medium.

5. The cryostat of claim 4, wherein the sealed pot comprises sintered material that facilitates thermal budget optimization, and wherein the sintered material comprises copper, gold, silver, or platinum.

6. The cryostat of claim 1, wherein the sealed pot is vacuum sealed or cryogenically sealed.

7. The cryostat of claim 1, wherein the helium medium is helium-4 or helium-3.

8. The cryostat of claim 1, wherein an outlet port of the pump is coupled to the sealed pot to provide a return path for the helium medium to the sealed pot.

9. The cryostat of claim 1, wherein the intermediate thermal stage comprises copper, gold, silver, brass, platinum, or a combination thereof.

10. The cryostat of claim 1, wherein the intermediate thermal stage comprises a feedthrough element that intervenes in a wiring structure that facilitates propagation of electrical signals between the 4-K stage and the cold plate stage.

11. The cryostat of claim 1, further comprising:

a pumping line that couples an inlet port of the pump and the intermediate thermal stage via the 4-K stage, wherein the pump is located external to the cryostat.

12. A cryostat comprising:

a still stage directly coupled mechanically to an intermediate thermal stage via a support rod, wherein the intermediate thermal stage provides additional cooling capacity for the cryostat, wherein the still stage and the intermediate thermal stage are included among a plurality of thermal stages intervening between a 4-kelvin (4-K) stage and a cold plate stage, wherein the intermediate thermal stage is directly coupled mechanically to the cold plate stage via respective support rods, and wherein a pump coupled to the intermediate thermal stage enables circulation of a helium medium through a sealed pot coupled to the intermediate thermal stage to maintain temperature of the intermediate thermal stage below a defined threshold.

13. The cryostat of claim 12, wherein the still stage comprises a feedthrough element that intervenes in a wiring structure that facilitates propagation of electrical signals between the 4-K stage and the cold plate stage via the intermediate thermal stage.

14. The cryostat of claim 12, wherein the still stage provides passage for a pumping line that couples an inlet port of the pump and the intermediate thermal stage via the 4-K stage, and wherein the pump is located external to the cryostat.

15. The cryostat of claim 12, wherein the plurality of thermal stages further includes an additional intermediate thermal stage that provides additional cooling capacity for the cryostat, and wherein the intermediate thermal stage and the additional intermediate thermal stage are directly coupled to opposing sides of the still stage via respective support rods.

16. The cryostat of claim 15, wherein the additional intermediate thermal stage operates at a temperature of about 1 kelvin.

17. The cryostat of claim 12, wherein the intermediate thermal stage operates at a temperature of about 300 millikelvin (mK).

18. A cryostat comprising:

a sealed pot that facilitates evaporative cooling of a helium medium, wherein the sealed pot is coupled to an intermediate thermal stage that provides additional cooling capacity for the cryostat, wherein the intermediate thermal stage is directly coupled mechanically to a still stage via a support rod, and wherein the still stage and the intermediate thermal stage are included among a plurality of thermal stages intervening between a 4-kelvin (4-K) stage and a cold plate stage; and an additional sealed pot coupled to an additional intermediate thermal stage that provides additional cooling capacity for the cryostat, wherein the plurality of thermal stages further comprise the additional intermediate thermal stage.

19. The cryostat of claim 18, wherein the helium medium is helium-4 or helium-3.

20. The cryostat of claim 18, wherein the sealed pot comprises sintered material that facilitates thermal budget optimization, and wherein the sintered material comprises copper, gold, silver, or platinum.

21. The cryostat of claim 18, wherein the intermediate thermal stage and the additional intermediate thermal stage are directly coupled mechanically to opposing sides of the still stage via respective support rods.

22. The cryostat of claim 18, wherein the sealed pot is coupled to a pump located external to the cryostat via a pumping line, and wherein the 4-K stage provides passage for the pumping line.

23. The cryostat of claim 18, wherein the sealed pot is coupled to a pump located external to the cryostat via a condenser line, and wherein the 4-K stage provides passage for the condenser line.

* * * * *